US005328344A

United States Patent [19]

Sato et al.

[11] Patent Number: 5,328,344

[45] Date of Patent: Jul. 12, 1994

[54] ENCLOSED TYPE ROTARY COMPRESSOR

[75] Inventors: Koichi Sato; Susumu Kawaguchi, both of Shizuoka, Japan

[73] Assignee: Mitsubishi Denki Kabushiki Kaisha, Tokyo, Japan

[21] Appl. No.: 54,093

[22] Filed: Apr. 30, 1993

[30] Foreign Application Priority Data

Jun. 22, 1992 [JP] Japan ..... 4-162775

[51] Int. Cl.[5] ..... F01C 21/06

[52] U.S. Cl. ..... 418/85; 418/60; 418/101; 417/367; 417/902

[58] Field of Search ..... 418/60, 83, 85, 96, 418/101; 417/902, 367

[56] References Cited

U.S. PATENT DOCUMENTS 3,285,504 11/1966 Smith ..... 417/902
4,518,330 5/1985 Asami et al. .
4,645,429 2/1987 Asami et al. .
4,968,231 11/1990 Zimmern et al. ..... 418/85
4,971,529 11/1990 Gannaway et al. ..... 418/60
5,087,170 2/1992 Kuosokabe et al. ..... 417/902

FOREIGN PATENT DOCUMENTS 4722035 6/1972 Japan ..... 418/85
63-82081 5/1988 Japan .
63-39798 8/1988 Japan .
1-300073 12/1989 Japan .

*Primary Examiner*—Richard A. Bertsch
*Assistant Examiner*—Charles G. Freay
*Attorney, Agent, or Firm*—Oblon, Spivak, McClelland, Maier & Neustadt

[57] ABSTRACT

The rotary compressor is constructed such that two oil cooler pipes are arranged in the vicinity of two compressing elements located at the opposite ends of an electrically driving element. With this construction, cooling performances of the rotary compressor can be doubled. In addition, since the two oil cooler pipes and two heat exchangers are connected to each other in series, there does not arise a necessity for enlarging a volume of the rotary compressor by increasing a diameter of the same. Alternatively, the rotary compressor may include a cooler pipe for conducting refrigerant to an oil cooler pipe and a fan for simultaneously forcibly cooling an enclosed vessel and the cooler pipe. In this case, since the temperature of refrigerant gas to flow into the oil cooler pipe can be lowered, the lubricant can be cooled at a high efficiency. Thereby, it is provided an enclosed type rotary compressor which can exhibit sufficiently high performances, high properties and high reliability without any necessity for enlarging a volume of the rotary compressor.

6 Claims, 4 Drawing Sheets

ENCLOSED TYPE ROTARY COMPRESSOR

BACKGROUND OF THE INVENTION

1. Field of the Invention

The present invention relates generally to an enclosed type rotary compressor employable for a refrigerating unit for a refrigerator or the like, an air conditioner or the like. More particularly, the present invention relates to an enclosed type rotary compressor for cooling a lubricant oil and a compressing element, each of which is heated up to an elevated temperature during running.

2. Description of the Prior Art

FIG. 3 is a vertical sectional view of a conventional enclosed type rotary compressor as disclosed in an Examined Japanese Patent Publication (Kokai) Sho-63-39798, and FIG. 4 is a vertical cross-sectional view of the enclosed type rotary compressor taken along line A—A in FIG. 3.

In FIG. 3 and FIG. 4, reference numeral 1 designates an enclosed vessel. The enclosed vessel 1 is composed of three enclosed vessel segments, i.e., an enclosed vessel segment 1*a*, an enclosed vessel segment 1*b* and an enclosed vessel segment 1*c*, and a lubricant 4 is hermetically stored in the enclosed vessel 1. An electrically (hereinafter "electrically driving element") driving element 2 consists of a stator 2*a* and a rotor 2*a*, and a compressing element 3 includes as essential components a cylinder 3*a*, an end bearing 2*b*, a main shaft bearing 3*c*, a rolling piston 3*d* and a crankshaft 3*e* by way of which power generated by the electrically driving element 2 is transmitted to the compressing element 3. The electrically driving element 2 and the compressing element 3 are enclosed in the vessel 1. Reference numeral 5 designates an oil supplying pipe. A spirally extending oil supplying spring 5*a* received in the oil supplying pipe 5 is rotated by the crankshaft 3*e*, causing a lubricant 4 to be supplied to the compressing element 3. Reference numeral 6 designates a discharge cover for attenuating pulsating pressure wave of refrigerant gas discharged through a discharge port 3*f* formed through the end bearing 3*b*, and reference numeral 6*a* designates a refrigerant discharge port formed through the discharge cover 6. Reference numeral 6*b* designates a plurality of fixing screws each serving to fixedly securing the discharge cover 6 to the end bearing 3*b*. Reference numeral 7 designates a discharge pipe for supplying the refrigerant to an oil cooler condenser 8, and reference numeral 9 designates a loop-shaped oil cooler pipe of which lower part is immersed in the lubricant 4. Reference numeral 10 designates an ordinary condenser disposed in a refrigerant circuit, reference numeral 11 designates a pressure-reducing (regulator) unit, reference numeral 12 designates an evaporator, and reference numeral 13 designates a suction pipe. In addition, reference numeral 14 designates a terminal portion by way of which electricity is supplied to the electrically driving element 2. Next, a mode of operation of the conventional enclosed type rotary compressor as constructed in the aforementioned manner will be described below.

As the refrigerant gas is compressed by the compressing element 3, it is discharged into the enclosed vessel 1 through the refrigerant discharge port 6*a* of the discharge cover 6, and thereafter, it is supplied via the discharging pipe 7 to the oil cooler condenser 8 in which the heat of the refrigerant gas is radiated. Subsequently, the cooled refrigerant gas is introduced into the oil cooler pipe 9 of which immersed part performs heat exchanging between the refrigerant and the lubricant 4 in the vessel 1 so as to cool the lubricant 4. The refrigerant is heated again as it passes through the oil cooler pipe 9, and the heated refrigerant is delivered to the condenser 10 in which the heat of the refrigerant is radiated, causing it to be liquidized. The liquidized refrigerant is delivered via the pressure-reducing unit 11 to the evaporator 12 in which it is vaporized and then sucked in the compressing element 3 again, whereby a single refrigerating cycle is completed.

FIG. 5 is a schematic sectional view of an oil cooling mechanism employable for a conventional multistage type oil cooling screw compressor as disclosed in Unexamined Japanese Utility Model Publication (Kokai) UM-Sho-63-82081.

In FIG. 5, reference numeral 25 designates oil separators, reference numeral 26 designates oil coolers, and reference numeral 27 designates oil return lines. In addition, reference numeral 28 designates a casing. Three rotors 29 are accommodated in the casing 28, and three nozzles 30 are disposed in the casing 28 so as to allow oil to be returned to compressing chambers of the rotors 29 during a step of compressing.

With the oil cooling mechanism as constructed in the above-described manner, as the oil flows through the oil coolers 26 and the oil return lines 27, it is cooled during the compressing step in the presence of a differential pressure $P_1 - P_2$ wherein discharge pressure in each oil separator 25 is represented by $P_1$ and pressure in a compressing chamber of each rotor 29 during the compressing step is represented by $P_2$. After the oil is cooled, it is returned to the compressing chamber of each rotor 29 so as to compress the oil.

FIG. 6 is a schematic sectional view of an oil cooling mechanism employable for a conventional air cooling type oil supplying compressor as disclosed in Unexamined Japanese Patent Publication Hei-1-300073.

In the drawing, reference numeral 25 designates an oil separator, reference numeral 26 designates an oil cooler, reference numeral 31 designates an oil pipe, reference numeral 32 designates a cooling fan, and reference numeral 33 designates a main body of the compressor.

With the oil cooling mechanism constructed in the above-described manner, oil contained in the high pressure air discharged from the compressor 33 is separated from air in the oil separator 25, and as the oil is increasingly accumulated on the bottom of the oil separator 25, it is discharged to the oil cooler 26 via the oil pipe 31 in the presence of a differential pressure $P_3 - P_4$ wherein pressure in the oil separator 25 is represented by $P_3$ and suction pressure of the compressor 33 is represented by $P_4$. Subsequently, the oil is cooled by rotating the cooling fan 32, and then, it returns to the suction side of the compressor 33.

As is apparent from the above description, it is an essential condition for each of the conventional enclosed type rotary compressors as mentioned above that the rotary compressor is designed with small dimensions in order to minimize the volume of the compressor. For this reason, it is practically difficult to maintain a large space for storing the oil cooler pipe 9 enough to effectively cool the lubricant 4. For example, in case that a single compressing element 3 including a compressing chamber having a large displacement volume or two compressing elements 3 disposed at the opposite ends of the electrically driving element 2, which generate a large heat quantity, are employed for a compressor, necessary cooling properties can not be obtained with the compressor with the result that the temperature of a lubricant is elevated, and moreover, the temperature of each compressing element 3 is also elevated. Consequently, there arise serious malfunctions that the refrigerating capability of the rotary compressor is reduced due to the preheating the refrigerating gas, and the bearing is seriously damaged or injured due to reduction of the viscosity of the oil, resulting in the rotary compressor failing to operate normally.

The oil cooling unit employed for the conventional multistage oil cooling type screw compressor or the conventional air cooling type oil supplying compressor includes means for directly cooling an oil in the oil coolers 26, and after completion of the oil cooling, the cooled oil is returned to the compressing chamber of the compressor. With such construction, when the oil fails to be accumulated in any one of the oil separators because of some operating conditions or environmental conditions, the high pressure refrigerating gas to be compressed flows through the oil line to reach the compressing chamber of the rotary compressor. This leads to the result that an amount of compressing operation to be performed is substantially increased, causing a large amount of energy to be undesirable consumed.

SUMMARY OF THE INVENTION

The present invention has been made in consideration of the aforementioned problems to be solved. Therefore, an object of the present invention is to provide an enclosed type rotary compressor including oil cooler pipes each having sufficiently high cooling properties without any necessity for enlarging a volume of the rotary compressor. Another object of the present invention is to provide an enclosed type rotary compressor including a lubricant cooling mechanism wherein stable cooling properties are assured under any operative condition without an occurrence of reduction of an efficiency of the rotary compressor due to reverse flow of high pressure refrigerant gas or the like.

According to the first aspect of the invention, an enclosed type rotary compressor is constructed such that refrigerant gas discharged from one of compressing elements passes through a first heat exchanger to enter a first oil cooler, the refrigerant gas discharged from the first oil cooler pipe passes through a second heat exchanger to enter a second oil cooler pipe, and the refrigerant gas discharged from the second oil cooler flows into a refrigerant circuit.

With the enclosed type rotary compressor according to the fist aspect of the present invention, since two oil cooler pipes are arranged at the opposite ends of the enclosed vessel, the cooling properties of the rotary compressor are doubled, and moreover, the capability of cooling lubricant stored in the enclosed vessel is also doubled. In addition, since the temperature difference between the lubricant and the refrigerant gas can be enlarged, the rotary compressor exhibits an excellent heat exchanging efficiency, resulting in the total length of both the oil cooler pipes being shortened. Further, since the two oil cooler pipes are connected to each other in series, the lubricant can be cooled by the two oil cooler pipes each having sufficiently high cooling properties. Thus, there does not arise a malfunction that piping is achieved in an undesirable complicated manner.

According to the second aspect of the invention, an enclosed type rotary compressor is constructed such that refrigerant gas discharged from a compressing element is conducted to a cooling pipe disposed outside of an enclosed vessel and the cooling pipe and the enclosed vessel are simultaneously forcibly cooled by rotating a fan.

With the enclosed type rotary compressor according to the second aspect of the present invention, since the cooling pipe for conducting the refrigerant gas to the oil cooler pipe is forcibly cooled by rotating the fan, the refrigerant gas flowing from the cooling pipe into the oil cooler pipe can substantially be cooled to a lower temperature compared with the case that the refrigerant gas passes through an ordinary heat exchanger. Thus, since the temperature difference between the refrigerant gas and the lubricant heated up to an elevated temperature can be enlarged and a heat exchanging rate of the lubricant can be improved, the lubricant can be cooled at a high efficiency.

DETAILED DESCRIPTION OF THE PREFERRED EMBODIMENTS

The present invention will be described in detail hereinafter with reference to the accompanying drawings which illustrate two preferred embodiments thereof.

Figure 1:
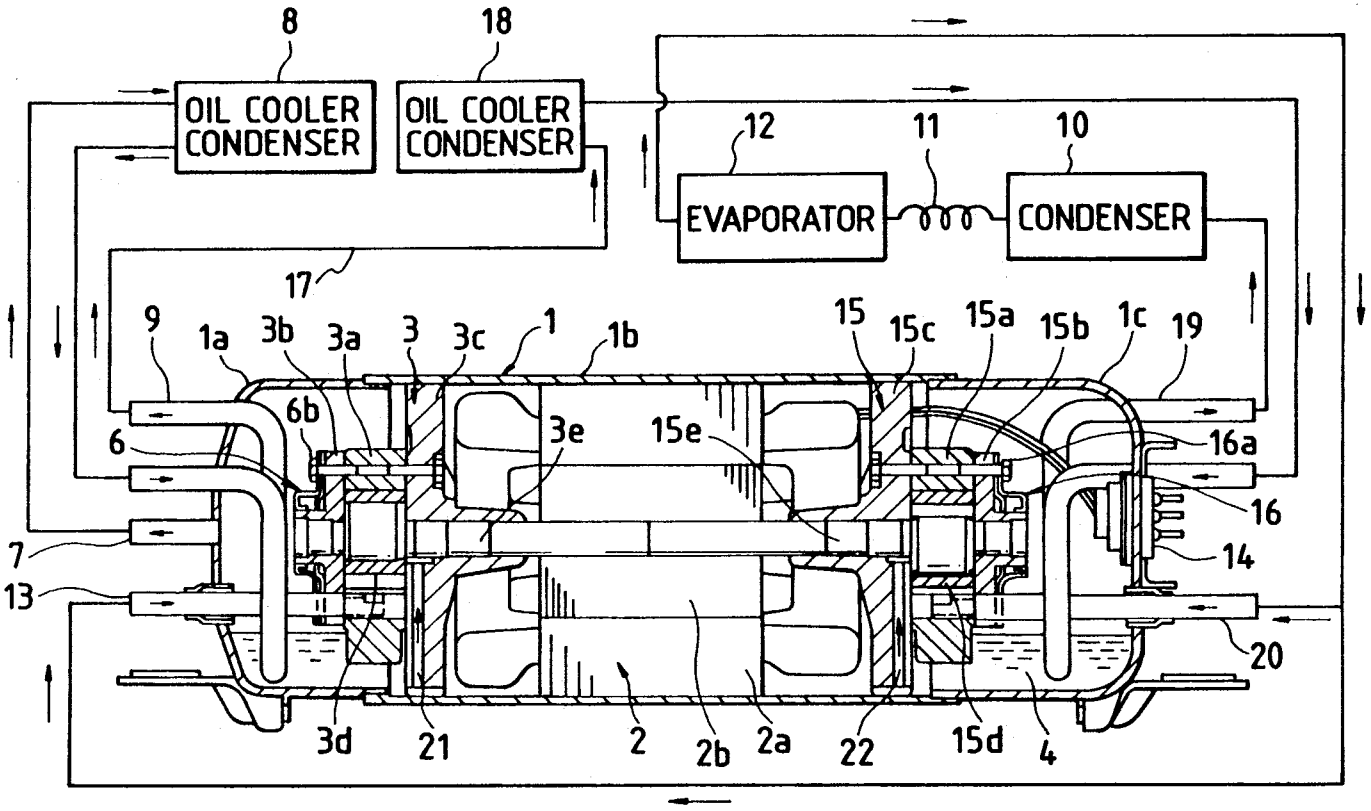
FIG. 1 is a vertical sectional view of an enclosed type rotary compressor in accordance with a first embodiment of the present invention.

FIG. 1 is a vertical sectional view of an enclosed type rotary compressor in accordance with a first embodiment of the present invention. It should be noted that same or similar components as those of each of the conventional rotary compressors are represented by same reference numerals, and particularly, reference numerals 1 to 14 represent the entirely same components as those of each of the conventional rotary compressors. Thus, repeated description on these components will not be required.

In FIG. 1, reference numeral 15 designates a right-side compressing element adapted to be driven by an electrically driving element 2 in synchronization with a left-side compressing element 3. Similar to the left-side compressing element 3, the right-side compressing element 15 is composed of a cylinder 15*a*, an end bearing 15*b*, a main bearing 15*c*, a rolling piston 15*d* and a crankshaft 15*e* by way of which the power generated by the electrically driving element 2 is transmitted to the right-side compressing element 15. Reference numeral 16 designates a discharge cover for attenuating the pulsation pressure wave of a refrigerant gas to be discharged through a discharge hole formed in the end bearing 15*b*, and reference numeral 16*a* designates a plurality of fixing screws each serving to fixedly secure the discharge cover 16 to the end bearing 15*b*. Reference numeral 17 designates a discharge pipe by way of which the refrigerant gas is supplied to an oil cooler condenser 18 from an oil cooler pipe 9, and reference numeral 19 designates a loop-shaped oil cooler pipe of which lower part is immersed in the lubricant 4 in an enclosed vessel 1. In addition, reference numeral 21 designates a lubricant suction hole by way of which the lubricant 4 is delivered to the left-side compressing element 3, and reference numeral 22 designates a lubricant suction hole by way of which the lubricant 4 is delivered to the right-side compressing element 15.

Next, an operation of the enclosed type rotary compressor constructed in accordance with the first embodiment of the present invention will be described below.

As the refrigerant gas is compressed by the left-side compressing element 3 and the right-side compressing element 15, it is discharged into the enclosed vessel 1 through a refrigerant outlet port (not shown) on the discharge cover 6 or the discharge cover 16, and thereafter, it is delivered from the discharge pipe 7 to an oil cooler condenser 8 in which the heat of the refrigerant gas is radiated. Subsequently, the refringent gas flows in an oil cooler pipe 9 so that heat exchanging is achieved between the lubricant 4 and a part of the coil cooler pipe 9 immersed in the lubricant 4 so as to cool the lubricant 4. A series of steps for executing a refrigerating cycle are same to those for each of the conventional enclosed type rotary compressors.

As the refrigerant gas passes through the oil cooler pipe 9, it absorbs heat from the lubricant 4. The refrigerant gas heated by the lubricant 4 is delivered via the discharge pipe 17 to the second oil cooler condenser 18 in which the heat of the refrigerant gas is radiated. Subsequently, the refrigerant gas flows in the oil cooler pipe 19 so that heat exchanging is achieved between the lubricant 4 and a part of the oil cooler pipe 19 immersed in the lubricant 4 again so as to cool the lubricant 4. The refrigerant gas is heated again as it passes through the oil cooler pipe 19 is delivered to a condenser 10 in which the heat of the refrigerant gas is radiated and the gas is condensed. The liquidized refrigerant is delivered via pressure-reducing unit 11 to an evaporator 12 in which it is vaporized, and thereafter, the refrigerant gas is introduced into the compressing elements 3 and 15 via a suction pipes 13 and 20 to complete a single refrigerating cycle. This refrigerating cycle is repeated.

Particularly, since the enclosed type rotary compressor constructed in accordance with the first embodiment of the present invention is equipped with a pair of oil cooler pipes 9 and 19, the cooling properties of the rotary compressor are doubled, and moreover, the capability of cooling the lubricant in the enclosed vessel 1 is also doubled. In addition, since the temperature difference between the lubricant and the refrigerant gas can be enlarged compared with the case that either one of the oil cooler pipes 9 and 19 is elongated, the rotary compressor exhibits an excellent heat exchanging efficiency. This leads to the result that a total length of both the oil cooler pipes 9 and 19 can be shortened.

The lubricant 4 cooled in the above-described manner is delivered to the compressing elements 3 and 15 via the suction holes 21 and 22 so that it is used to cool relevant components and additionally serves as sealing means for slidable portions in the rotary compressor.

This embodiment exemplifies the case that the oil cooler condenser 8 is disposed between the discharge pipe 7 and the oil cooler pipe 9, and the oil condenser 18 is disposed between the discharge pipe 17 and the oil cooler pipe 19. Alternatively, the present invention can be carried out with the same advantageous effects as mentioned above in combination of forcible air cooling achieved by rotating a fan disposed at the position corresponding to either one of the oil cooler condensers 8 and 18 or with either one of the oil cooler condensers 8 and 18 dismounted from the rotary compressor.

Especially, with the enclosed type rotary compressor constructed in the first embodiment of the present invention, since the two oil cooler pipes 9 and 19 are connected to each other in series, the lubricant 4 can be cooled with sufficiently high cooling properties but without a piping structure becoming complicated.

Figure 2:
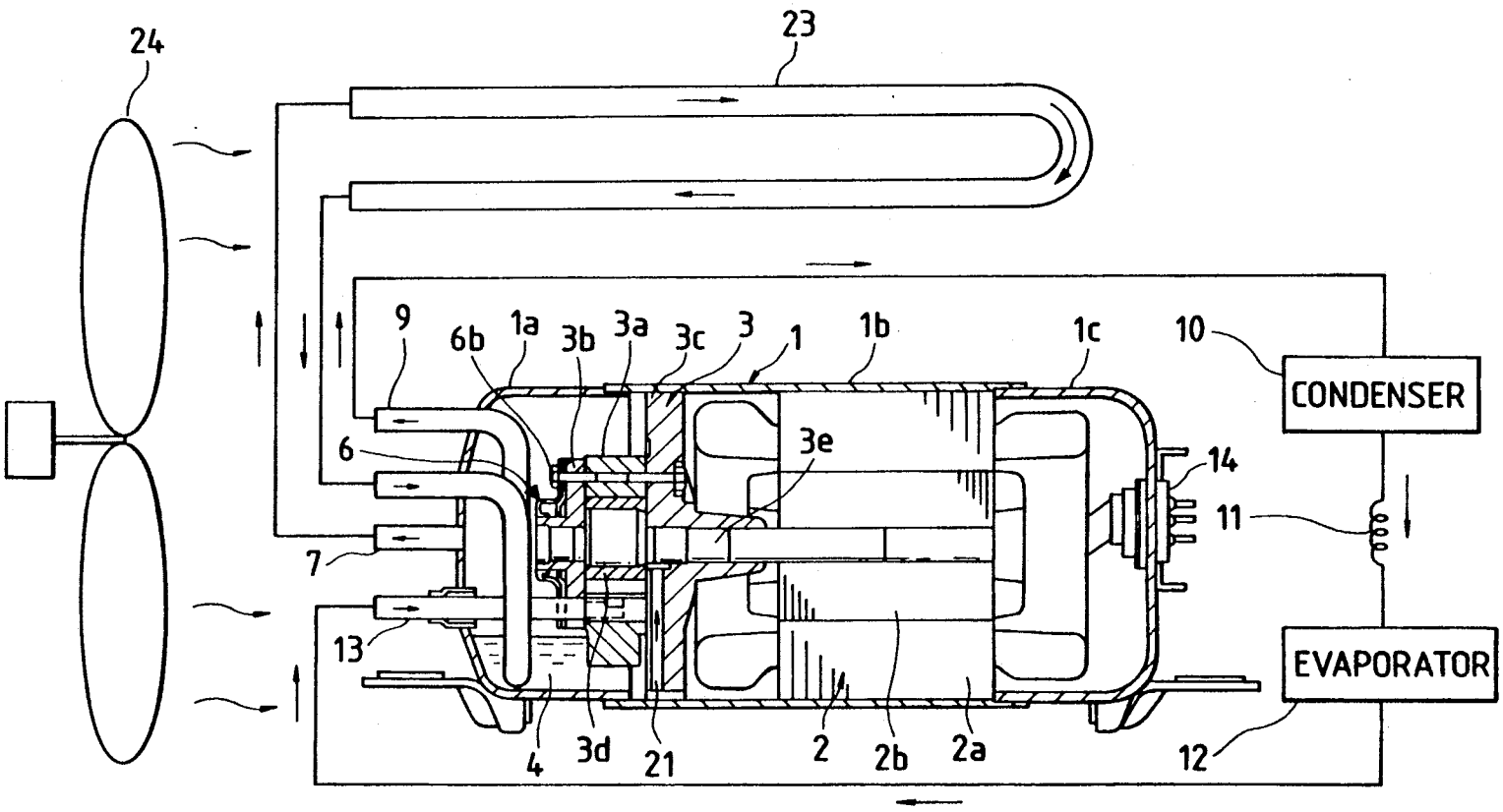
FIG. 2 is a vertical sectional view of a enclosed type rotary compressor in accordance with a second embodiment of the present invention.
Figure 3:
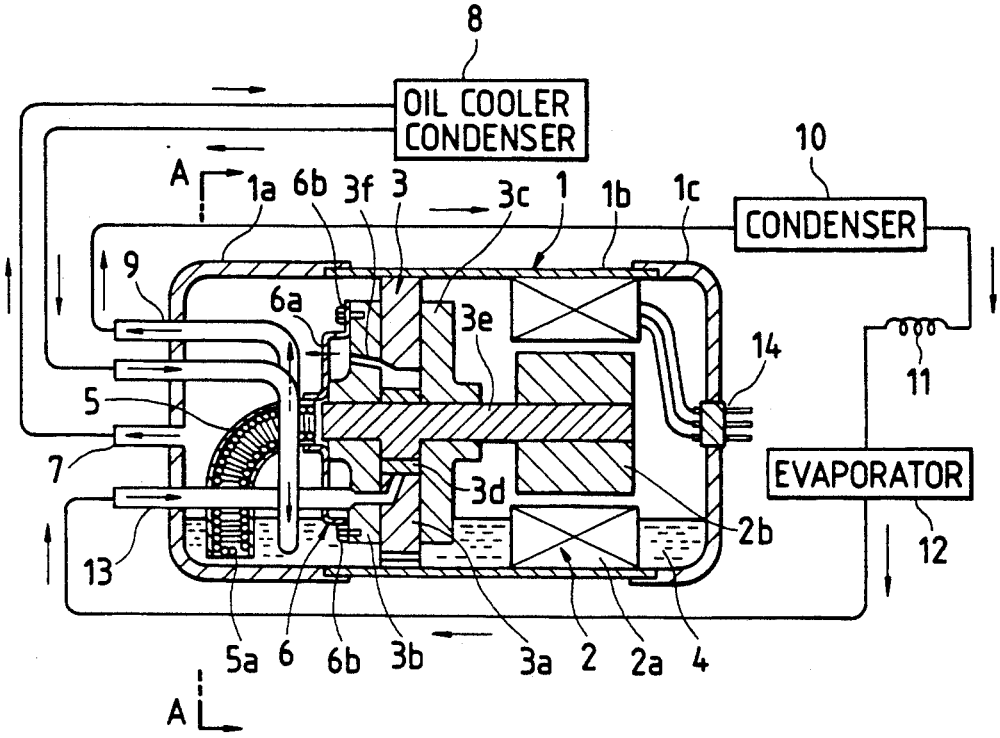
FIG. 3 PRIOR ART
FIG. 3 is a vertical sectional view of a conventional enclosed type rotary compressor.
Figure 4:
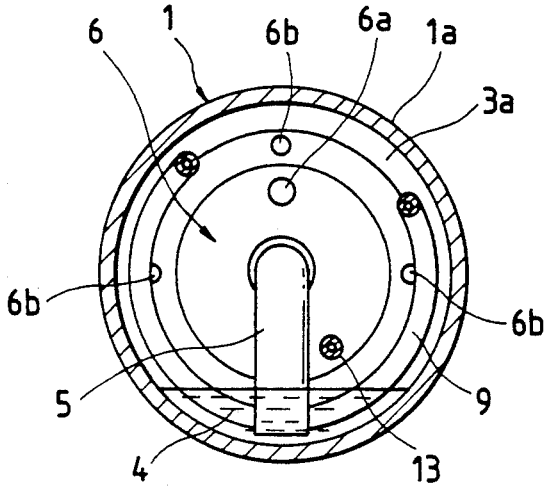
FIG. 4 PRIOR ART
FIG. 4 is a vertical cross-sectional view of the rotary compressor taken along line A—A in FIG. 3.
Figure 5:
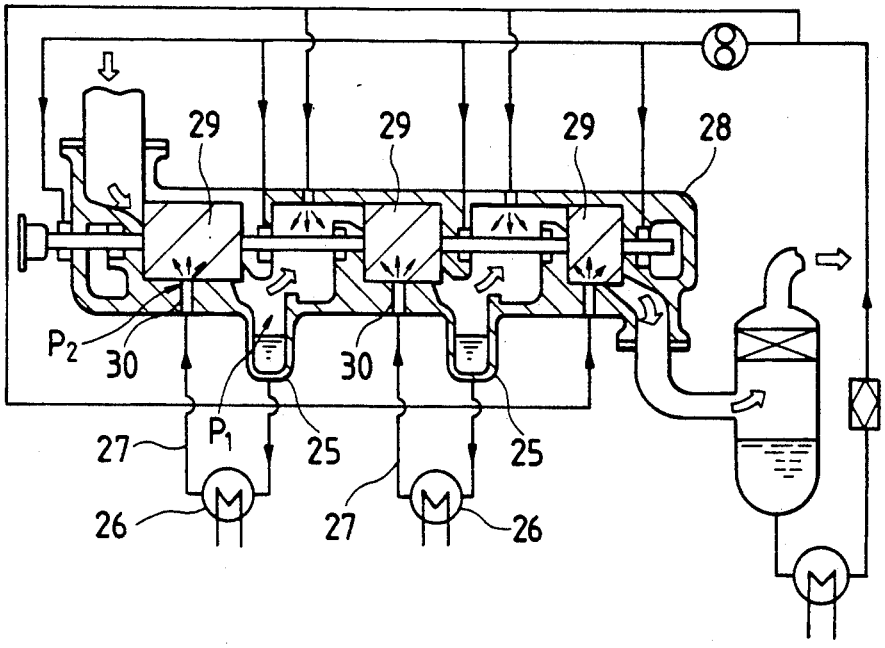
FIG. 5 PRIOR ART
FIG. 5 is a schematic sectional view of an oil cooling mechanism employable for a conventional multistage oil cooling type screw compressor.
Figure 6:
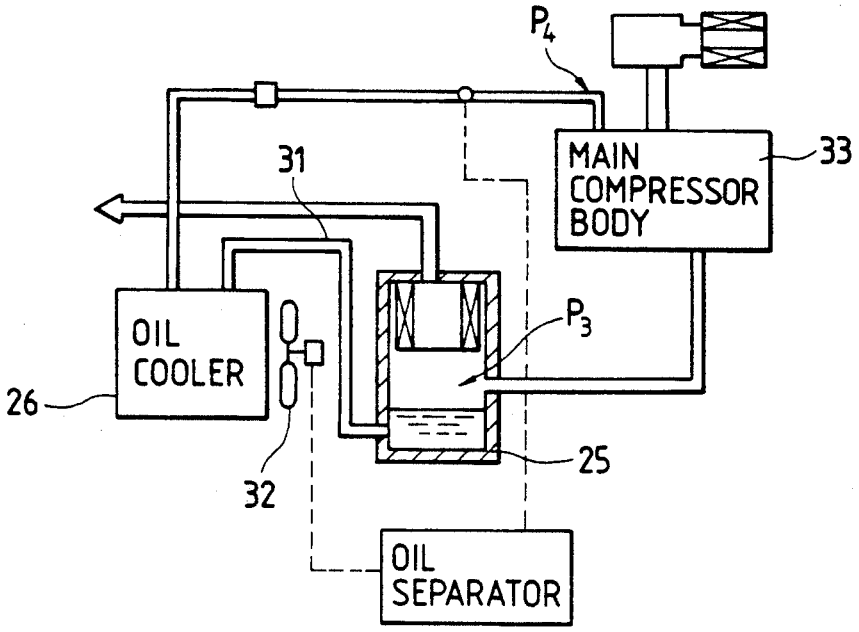
FIG. 6 PRIOR ART
FIG. 6 is a schematic sectional view of an oil cooling mechanism employable for a conventional air cooling type oil supplying compressor.

FIG. 2 is a vertical sectional view of an enclosed type rotary compressor in accordance with a second embodiment of the present invention. It should be noted that same or similar components as those of each of the conventional rotary compressor are represented by same reference numerals, and particularly, reference numerals 1 to 7 and 9 to 14 represent the entirely same components as those of each of the conventional rotary compressors. Thus, repeated description on these components will not be required.

In FIG. 2, reference numeral 23 designates a cooling pipe which serves to conduct to an oil cooler pipe the refrigerant gas discharged from a discharge pipe 7, and reference numeral 24 designates a fan for simultaneously forcibly cooling an enclosed vessel 1 and the cooling pipe 23 with blown air.

Next, an operation of the enclosed type rotary compressor constructed in accordance with the second embodiment of the present invention will be described below.

An operation of the rotary compressor is same to that of each of the conventional rotary compressors with the exception that the cooling pipe 23 is substituted for the oil cooler condenser 8 and the fan 24 is disposed for the purpose of simultaneously forcibly cooling the enclosed vessel 1 and the cooling pipe 23. As the refrigerant gas passes through the cooling pipe 23, it is forcibly cooled with blown air so as to allow its temperature to be sufficiently lowered. After it is sufficiently cooled, it is conducted to the oil cooler pipe 9 to cool the lubricant 4 which in turn is sucked in the compressing element 3 to cool the relevant components of the compressing element 3.

With the rotary compressor constructed in accordance with the second embodiment of the present invention, since the cooling pipe 7 for conducting the refrigerant gas to the oil cooler pipe 9 is forcibly cooled by rotating the fan 24, the refrigerant gas which flows from the cooling pipe 7 to the oil cooler pipe 9 can be cooled to a lower temperature much more than the case that it flows through an ordinary heat exchanger, and moreover, the temperature difference between the refrigerant gas and the lubricant 4 can be enlarged, resulting in a heat exchanging efficiency being substantially improved. Consequently, the lubricant 4 can effectively be cooled.

The process of forcibly cooling the whole enclosed vessel 1 by rotating the fan 24 has been hitherto widely known as a typical process of cooling the lubricant 4 and the compressing element 3. This process is usually designed such that a switch for the fan 24 is turned on when the environmental temperature of the rotary compressor reaches a predetermined temperature. In this embodiment, however, since the rotary compressor is constructed in such a manner as to simultaneously forcibly cool the enclosed vessel 1 and the cooling pipe 7 for conducting the refrigerant gas to the oil cooler pipe 9 with blown air, a cooling efficiency can substantially be improved with a same volume of blown air compared with the case that only the enclosed vessel 1 is forcibly cooled with blown air. This leads to the result that the temperature for turning on the switch of the fan 24 can be set to a lower temperature. In other words, in case that the rotary compressor operates under a same environmental condition, the operating rate of the fan 24 can be set to a low level much more than the case that only the enclosed vessel 1 is forcibly cooled .with blown air, resulting in the fan 24 being practically used for a longer period of time.

As is apparent from the above description, a characterizing feature of the enclosed type rotary compressor constructed in accordance with the first embodiment of the present invention as shown in FIG. 1 consists in that the oil cooler pipes 9 and 19 are arranged in the vicinity of the two compressing elements 3 and 15 located at the opposite ends of the enclosed vessel 1 with the electrically driving element 2 interposed therebetween. Conclusively, the rotary compressor as constructed in the above-described manner is provided according to a first aspect of the present invention as defined in claim 1.

Since the oil cooler pipes 9 and 19 are arranged at the opposite ends of the enclosed vessel 1, the cooling properties of the rotary compressor can be doubled, and moreover, the capability of the rotary compressor of cooling the lubricant hermetically stored in the enclosed vessel 1 can also be doubled. In addition, since the temperature difference between the lubricant and the refrigerant gas can substantially be enlarged compared with the case that the length of either one of the oil cooler pipes 9 and 19 is elongated, the heat exchanging efficiency of the rotary compressor can be improved. As a result, the total length of both the oil cooler pipes 9 and 19 can be shortened.

Further, since the oil cooler pipes 9 and 19 are arranged in the vicinity of the two compressing elements 3 and 15, the lubricant 4 sucked in the compressing elements 3 and 15 can effectively be cooled. Thus, there does not arise a malfunction that the temperature of the lubricant sucked in one of the compressing elements 3 and 15 located on the one side where one of the oil cooler pipes 9 and 19 is not arranged can not be lowered to a desired temperature like in case that an oil cooler pipe is arranged only at the one side of the enclosed vessel 1.

For example, in case that the present invention is applied to a rotary compressor adapted to generate a large amount of heat like the rotary compressor including the two compressing elements 3 and 15 at the opposite ends of the electrically driving element 2, sufficiently high cooling properties can be exhibited while suppressing not only elevation of the temperature of the lubricant but also elevation of the temperature of the compressing elements 3 and 15. Conclusively, the present invention has provided an enclosed type rotary compressor which can exhibit excellent performances and high reliability with a reduced space required for mounting it while avoiding a serious malfunction such as reduction of the refrigerating capability due to preheating of the sucked refrigerant gas, damage or injury of the bearing due to reduction of the viscosity of the lubricant or the like.

The enclosed type rotary compressor in accordance with the first embodiment of the present invention as shown in FIG. 1 is constructed such that an electrically driving element 2 and two compressing elements 3 and 15 located at the opposite ends of the latter are accommodated in an enclosed vessel 1, oil cooler pipes 9 and 19 are arranged in the vicinity of the two compressing elements 3 and 15 so that the refrigerant gas discharged from the compressing element 3 passes through an oil cooler condenser 8 serving as a first heat exchanger to enter a first oil cooler pipe 9, the refrigerant gas discharged from the first oil cooler pipe 9 passes through an oil cooler condenser 18 serving as a second heat exchanger to enter a second oil cooler pipe 19, and the refrigerant gas discharged from the second oil cooler pipe 19 flows through a refrigerant circuit consisting of a condenser 10, a pressure-reducing unit 11 and an evaporator 12.

With this construction, since two heat exchangers composed of the two oil cooler pipes 9 and 19 and the two oil cooler condensers 8 and 18 are connected to each other in series, piping can simply be achieved compared with the case that they are connected to each other in parallel. In addition, the rotary compressor can cool the lubricant 4 with sufficiently high cooling properties.

In addition, the enclosed type rotary compressor in accordance with the second embodiment of the present invention as shown in FIG. 2 is constructed such that an electrically driving element 2 and a compressing element 3 are accommodated in an enclosed vessel 1 and an oil cooler pipe 9 is arranged in the vicinity of the compressing element 3 so that the refrigerant gas discharged from the compressing element 3 is conducted to a cooling pipe 23 disposed outside of the enclosed vessel 1, simultaneous forcible cooling is achieved for the enclosed vessel 1 and the cooling pipe 23 by rotating a fan 24 adapted to forcibly cool the enclosed vessel 1, and subsequently, the cooled refrigerant gas is conducted to the oil cooler pipe 9.

With this construction, since the enclosed vessel 1 and the cooling pipe 23 for conducting the refrigerant gas to the oil cooler pipe 9 are simultaneously forcibly cooled with blown air by rotating the fan 24, the temperature of the refrigerant gas flowing into the oil cooler pipe 9 can be lowered and the temperature difference between the refrigerant gas and the lubricant 4 can be enlarged, whereby the lubricant 4 can be cooled at a high efficiency. Since a heat exchanging rate of the rotary compressor can substantially be improved compared with a process of cooling the lubricant 4 merely by forcible cooling of the enclosed vessel 1 by rotating the fan 24, the time when a switch for the fan 24 is turned on for the purpose of cooling is determined based on the environmental temperature which is preset to a lower level with the result that the operating rate of the fan 24 can be reduced, and moreover, the running life of the fan 24 can substantially be elongated. Further, since the lubricant is not directly cooled as a medium to be cooled but the refrigerant gas is cooled so as to allow the lubricant to be cooled by the cooled refrigerant gas, there does not arise a malfunction that the refrigerant gas discharged from the compressing element 3 flows back to the suction side of the latter under any operating condition. Thus, there is no possibility that the lubricant enters in the compressing line, resulting in an amount of operation being performed to increase while uselessly consuming energy.

It should be noted that both the oil cooler pipes 9 and 19 arranged in the vicinity of the two compressing elements 3 and 15 to cool the lubricant 4 stored in the enclosed vessel 1 are designed in the substantially U-shaped configuration of which part is immersed in a bath of lubricant 4 to cool the lubricant 4 as the refrigerant gas flows therethrough. However, to carry out the present invention, the configuration of each of the oil cooler pipes 9 and 19 to be immersed in the lubricant 4 should not be limited only to a specific one. Provided that it is proven that heat exchanging can be achieved at a high efficiency, any configuration is acceptable.

The oil cooler condenser 8 and the oil cooler condenser 18 are used as a first heat exchanger and a second heat exchanger for the rotary compressor constructed in accordance with the first embodiment of the present invention. Provided that it is proven that heat exchanging can be achieved to carry out the present invention, any type of heat exchanger is acceptable.

As is apparent from the above description, according to the first aspect of the present invention, the enclosed type rotary compressor is constructed such that an electrically driving element and two compressing element located at the opposite ends of the latter are accommodated in an enclosed vessel and two oil cooler pipes are arranged in the vicinity of the two compressing elements to cool the lubricant hermetically stored in the enclosed vessel. Thus, since the oil cooler pipes are arranged in the vicinity of the two compressing elements to cool the lubricant stored in the enclosed vessel, the cooling performances of the oil cooler pipes can be doubled without any necessity for enlarging a diameter of the enclosed vessel, and moreover, the capability of cooling the lubricant hermetically stored in the enclosed vessel can also be doubled. Further, since the temperature difference between the lubricant and the refrigerant can be enlarged compared with the case that the length of a single oil cooler pipe is elongated, a heat exchanging efficiency can be improved, resulting the total length of both the oil cooler pipes being shortened.

Therefore, when the present invention is applied to an enclosed type rotary compressor including two compressing elements at the opposite ends of an electrically driving element to generate a large amount of heat, sufficiently high cooling properties can be exhibited with the rotary compressor while suppressing not only elevation of the temperature of lubricant but also elevation of the temperature of the compressing elements. Further, an occurrence of serious malfunctions, i.e., reduction of the refrigerating capability due to preheating of sucked refrigerant gas and damage or injury of a bearing due to reduction of the viscosity of the lubricant can be avoided. Consequently, the present invention has provided an enclosed type rotary compressor which can exhibit a high performances and high reliability with a reduced space required for mounting it.

The refrigerant gas discharged from the compressing elements passes through a first heat exchanger to enter a first oil cooler pipe, the refrigerant gas discharged from the first oil cooler passes through a second heat exchanger to enter a second oil cooler pipe, and the refrigerant gas discharged from the second oil cooler pipe flows to a refrigerant circuit. Thus, since the two heat exchangers composed of two oil cooler pipes and two oil cooler condensers are connected to each other in series, piping can simply be achieved compared with the case that they are connected to each other in parallel. Additionally, the lubricant can be cooled with sufficiently high cooling properties.

With the enclosed type rotary compressor constructed according to the second aspect of the present invention, an electrically driving element and a compressing element are accommodated in an enclosed vessel and an oil cooler pipe is arranged in the vicinity of the compressing element so that the refrigerant gas discharged from the compressing element is conducted to a cooling pipe disposed outside of the enclosed vessel, simultaneous forcible air cooling is achieved for the enclosed vessel and the cooling pipe by rotating fan adapted to forcibly cool the enclosed vessel, and subsequently, the refrigerant gas is conducted to the oil cooler pipe.

With this construction, since the enclosed vessel and the cooling pipe for conducting the refrigerant gas to the oil cooler pipe are simultaneously forcibly cooled by rotating the fan, the temperature of the refrigerant gas to flow into the oil cooler pipe can be lowered, and moreover, the temperature difference between the refrigerant gas and the lubricant can be enlarged, resulting in the lubricant being cooled at a high efficiency. In addition, since a heat exchanging rate of the rotary compressor can substantially be improved compared with a process of cooling the lubricant merely by forcibly cooling the enclosed vessel with blown air by rotating the fan, the time when a switch for the fan is turned on is determined based on the environmental temperature which is present to a low level with the result that an operating rate of the fan can be lowered and an apparent running life of the fan be elongated. Further, since the lubricant is not directly cooled as a medium to be cooled but the refrigerant gas is cooled so as to allow the lubricant to be cooled by the cooled refrigerant gas, there does not arise a malfunction that after the refrigerant gas is discharged from the compressing element, it flows back to the suction side of the compressing element under any operating condition while uselessly consuming energy.

What is claimed is:

1. An enclosed type rotary compressor comprising:

an electrically driving element;

two compressing elements for compressing refrigerant gas, said compressing elements being located at opposite ends of said electrically driving element;

an enclosed vessel for accommodating said electrically driving element, compressing elements and a lubricant oil; and first and second oil cooler pipes for cooling said lubricant oil stored in said enclosed vessel;

wherein said refrigerant gas discharged from one of said compressing elements passes through a first heat exchanger to enter said first oil cooler pipe, said refrigerant gas discharged from said first oil cooler pipe passes through a second heat exchanger to enter a second oil cooler pipe, and said refrigerant gas discharged from said second oil cooler pipe flows into a refrigerant circuit.

2. An enclosed type rotary compressor as claimed in claim 1, wherein said first and second oil cooler pipes are loop-shaped and lower part of which is immersed in said lubricant oil.

3. An enclosed type rotary compressor as claimed in claim 1, wherein a lubricant suction hole is provided for each of said compressing elements to supply said lubricant oil.

4. An enclosed type rotary compressor as claimed in claim 1, wherein said first and second oil cooler pipes are loop-shaped and lower part of which is immersed in said lubricant oil.

5. An enclosed type rotary compressor as claimed in claim 1, wherein a lubricant suction hole is provided for each of said compressing elements to supply said lubricant oil.

6. An enclosed type rotary compressor comprising;

an enclosed vessel for accommodating an electrical driving element, a compressing element and lubricant oil;

an electrical driving element accommodated in said enclosed vessel;

a compressing element in said enclosed vessel for compressing refrigerant gas;

an oil cooler pipe for cooling said lubricant oil stored in said enclosed vessel, said oil cooler pipe being arranged in the vicinity of said compressing element in said enclosed vessel;

a cooling pipe disposed outside of said enclosed vessel and connected between said enclosed vessel and said oil cooler pipe such that refrigerant gas discharged from said compressing element is conducted to said cooling pipe to be cooled and fed to said oil cooler pipe; and a fan positioned to blow cooling air onto both said enclosed vessel and said cooling pipe so as to forcibly cool refrigerant gas in both said cooling pipe and said enclosed vessel.

* * * * *